US007055278B1

(12) United States Patent
Davis

(10) Patent No.: US 7,055,278 B1
(45) Date of Patent: Jun. 6, 2006

(54) PORTABLE TUBE CLEANING SYSTEM

(75) Inventor: Terry L. Davis, Yuma, AZ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 109 days.

(21) Appl. No.: 10/655,072

(22) Filed: Sep. 5, 2003

(51) Int. Cl.
*F41A 29/02* (2006.01)

(52) U.S. Cl. ..... 42/95

(58) Field of Classification Search ..... 42/95
See application file for complete search history.

(56) References Cited

U.S. PATENT DOCUMENTS 3,708,820 A * 1/1973 Schultea ..... 15/104.16
3,941,259 A * 3/1976 Hoffmeister et al. ..... 376/262
4,112,863 A * 9/1978 Nelson ..... 114/264
4,142,798 A * 3/1979 Barbee, Jr. ..... 356/138
4,318,658 A * 3/1982 McIntyre ..... 414/480
4,420,165 A * 12/1983 Goodin ..... 280/414.1
4,431,359 A * 2/1984 Toniolo ..... 414/139.9
4,469,346 A * 9/1984 Low ..... 280/414.1
4,529,349 A * 7/1985 Lutz ..... 414/478
4,704,062 A * 11/1987 Hale ..... 414/494
4,705,289 A * 11/1987 Weber ..... 280/414.1
4,749,317 A * 6/1988 Daniel ..... 410/26
4,864,837 A * 9/1989 Fielden, Jr. ..... 72/176
5,171,925 A * 12/1992 Mekler ..... 42/95
5,183,168 A * 2/1993 Fujimoto ..... 212/232
5,215,202 A * 6/1993 Fujimoto ..... 212/232
5,846,047 A * 12/1998 Riekki ..... 414/494
5,940,920 A * 8/1999 Hare et al. ..... 15/88
6,089,818 A * 7/2000 Hill et al. ..... 414/563
6,099,232 A * 8/2000 Dixon et al. ..... 414/494
6,155,770 A * 12/2000 Warhurst ..... 414/498
6,419,292 B1 * 7/2002 Calcote et al. ..... 296/35.3
2003/0068218 A1 * 4/2003 Landoll et al. ..... 414/812
2004/0018075 A1 * 1/2004 Sherman et al. ..... 414/476

FOREIGN PATENT DOCUMENTS

GB 2325894 A * 12/1998

* cited by examiner

*Primary Examiner*—Troy Chambers
(74) *Attorney, Agent, or Firm*—Alan P. Klein

(57) ABSTRACT

A portable cannon tube cleaning system that includes a trailer designed to be pulled to the field site of a cannon tube to be cleaned; a mechanism securely mounted to the floor of the trailer for providing vertical height adjustment; a main cleaner chassis assembly securely mounted to the height adjustment mechanism so that when the height adjustment mechanism is actuated the height of the main cleaner chassis assembly may be adjusted to be in line with the cannon tube to be cleaned; and a mechanism contained in the main cleaner chassis assembly for hauling a cleaning brush assembly through the cannon tube for as many cycles as required to adequately clean the tube for inspections.

14 Claims, 2 Drawing Sheets

PORTABLE TUBE CLEANING SYSTEM

BACKGROUND OF THE INVENTION

This invention relates generally to firearms, and more particularly to implements for barrel cleaning.

Accurate visual inspections and physical measurements are required to ensure that cannon tubes used in the field for the live testing of munitions are safe for repeated use. Residue left in the tubes by the munitions can interfere with the inspections and measurements. This residue must be removed first. In the past, the residue was removed manually. The process was time consuming and labor intensive. This generally yielded unacceptable results, requiring that the cleaning process be repeated.

SUMMARY OF THE INVENTION

It is therefore an object of this invention to clean cannon tubes in the field so that they are clean enough for required inspections.

This and other objects of the invention are achieved by a portable cannon tube cleaning system that includes a trailer designed to be pulled to the field site of a cannon tube to be cleaned; actuatable means securely mounted to the floor of the trailer for providing vertical height adjustment; a main cleaner chassis assembly securely mounted to the actuatable means so that when the means is actuated the height of the main cleaner chassis assembly may be adjusted to be in line with the cannon tube to be cleaned; and means contained in the main cleaner chassis assembly for hauling a cleaning brush assembly through the cannon tube for as many cycles as required to adequately clean the tube for inspections. The cleaning brush assembly includes a main cleaning head, a plurality of spiral brushes, a plurality of locking rings for holding the spiral brushes on the main cleaning head, and a front face mount, and a rear face mount for mounting the main cleaning head on the front and rear face mounts.

The cleaning system may be transported to the field, is fully self-contained, may be operated by one person, includes a vertical height adjustment mechanism and accommodates a wide range of cannon tube diameters. The cleaning head can accept a variety of brush materials (e.g., nylon, horse hair, boar bristle, stainless steel) so that the appropriate brush material may be selected depending on the nature of the residue to be removed. The system hauls the cleaning head through the cannon tube for as many cycles as required to clean the tube.

Additional advantages and features will become apparent as the subject invention becomes better understood by reference to the following detailed description when considered in connection with the accompanying drawings wherein:

DETAILED DESCRIPTION

Figure 1:
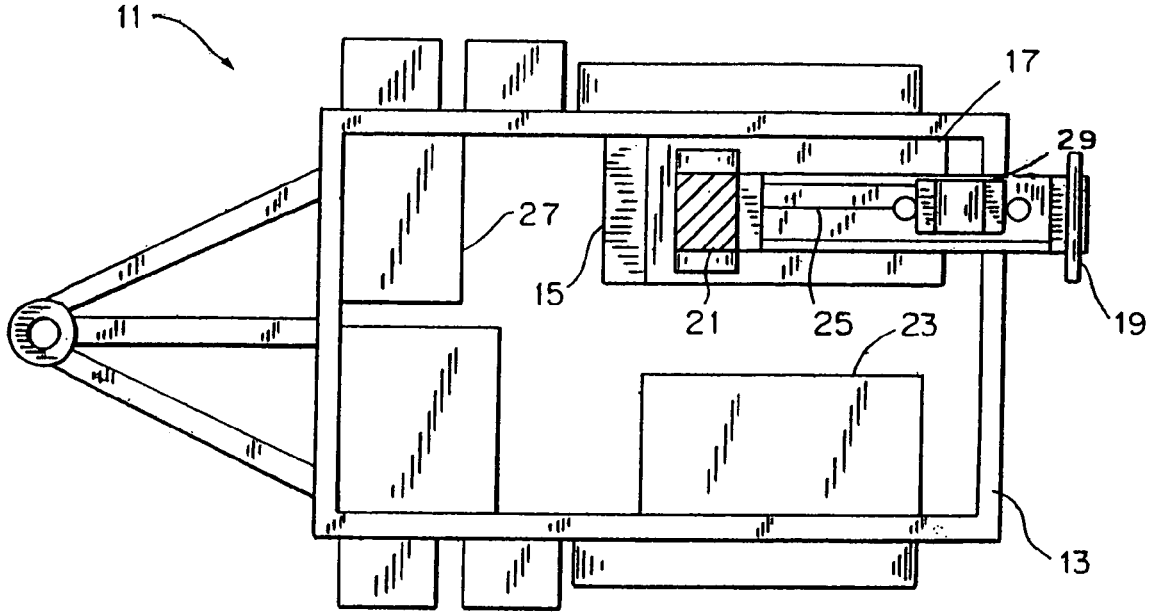
FIG. 1 is a top view of a portable cannon tube cleaning system in accordance with the invention.
Figure 2:
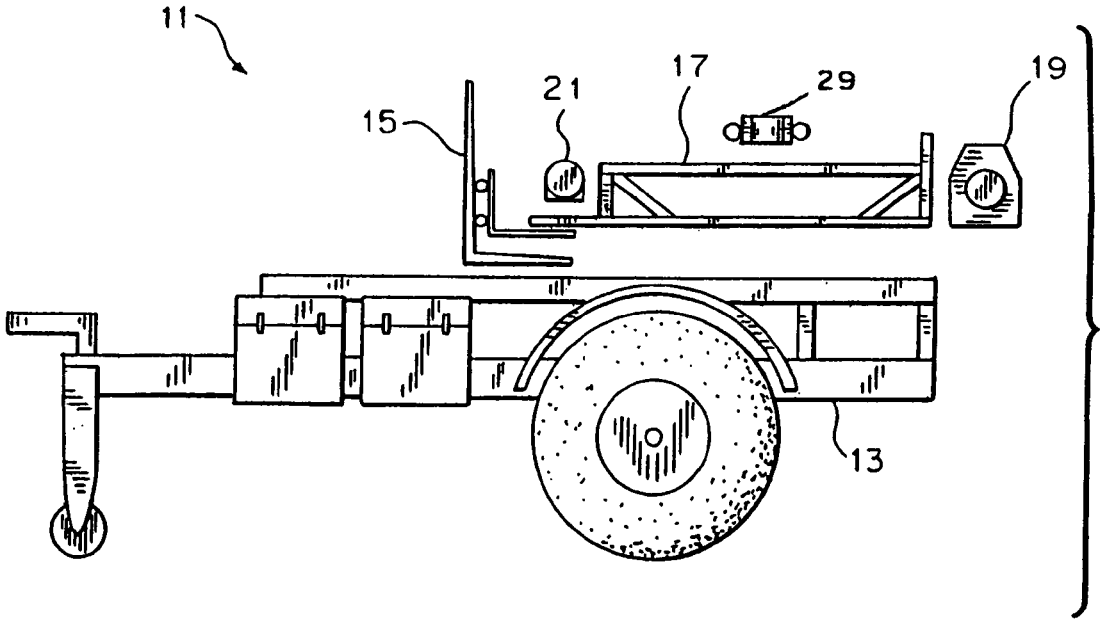
FIG. 2 is an exploded side view of a portable cannon tube cleaning system in accordance with the invention.

Referring to FIGS. 1 and 2, the portable cannon tube cleaning system 11 includes a trailer 13, an automatic or manually-operated lifting platform 15 having its base securely mounted to the floor of the trailer, and a main cleaner chassis assembly 17 securely mounted to the lifting platform. The main cleaner chassis assembly 17 has an end that is adapted to fit against the face of the cannon tube to be cleaned (not shown) and which accommodates a hollow adapter plate 19 selected to fit on the outer diameter of the cannon tube. The main chassis assembly 17 contains an electric, hydraulic, or an air winch 21 and a winch cable 25 connected to the winch. The winch is controlled by an on-board winch controller 23. The system may derive its power from either an on-board generator 27 or an external generator (not shown).

Figure 3:
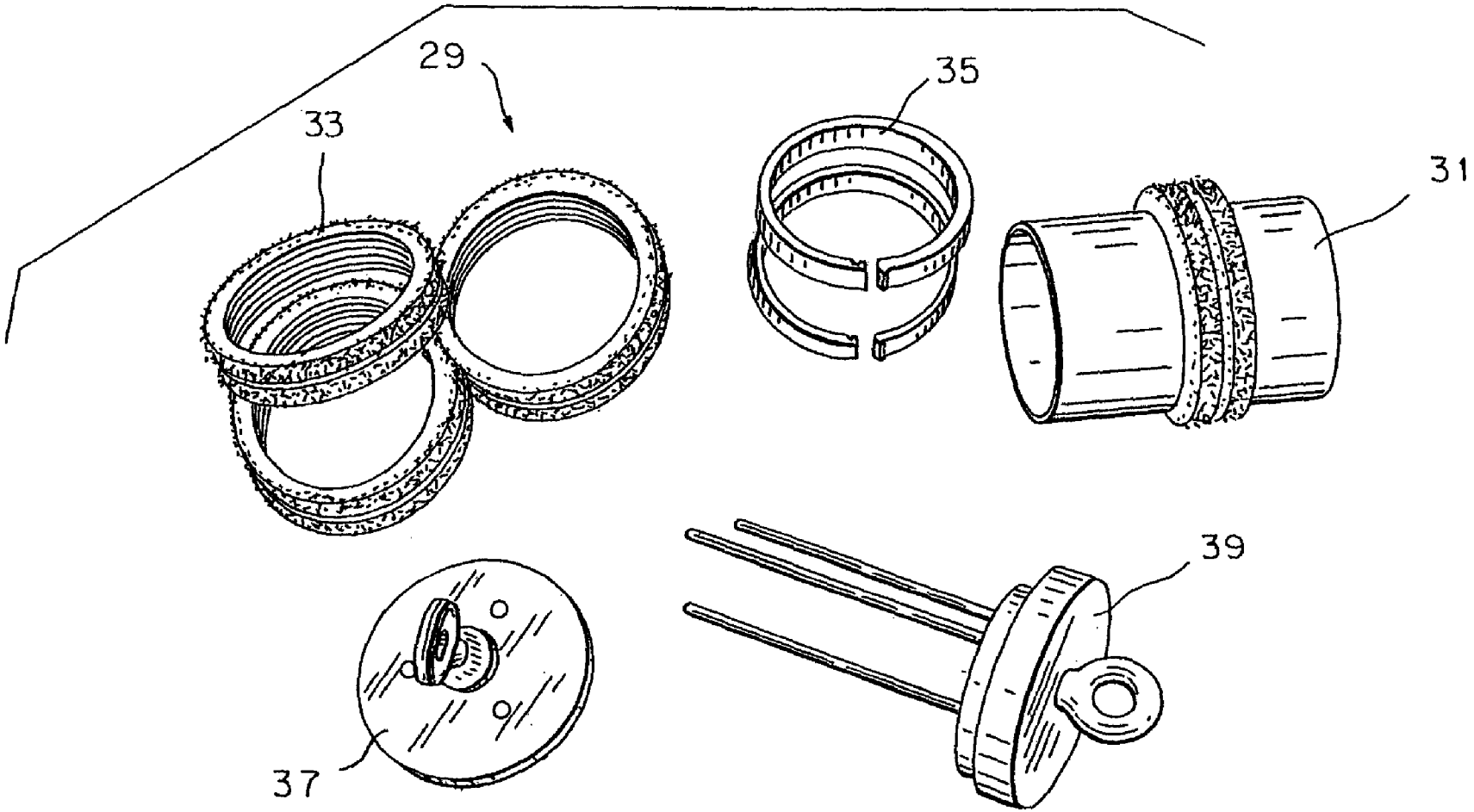
FIG. 3 is a cleaning brush assembly for use with the portable cannon tube cleaning system of the invention.

Referring to FIG. 3, a cleaning brush assembly 29 for use with the portable cannon tube cleaning system includes a main cleaning head 31, a plurality of spiral brushes 33 made of any of a variety of brush materials (e.g., nylon, horse hair, boar bristle, stainless steel), a plurality of locking rings 35 for holding the spiral brushes on the main cleaning head, and a front face mount 37 and a rear face mount 39 for mounting the main cleaning head. The cleaning brush assembly 29 is put together by locking the spiral brushes 33 on the main cleaning head 31 with the locking rings 35 and mounting the main cleaning head on the front and rear face mounts 37 and 39.

In operation, the trailer 13 is pulled by a motor vehicle to the site of the cannon tube to be cleaned. The vertical height of the main cleaner chassis assembly 17 is manually or automatically adjusted to be in line with the cannon tube to be cleaned by actuating the lifting platform 15. The main cleaner chassis assembly 17 is fitted against the face of the cannon tube, and the hollow adapter plate 19 is fitted on the outer diameter of the cannon tube. The free end of the winch cable 25 is dropped through the cannon tube and connected to the cleaning brush assembly 29. A solvent is applied to the cleaning brush assembly, and the winch controller 23 controls the winch to haul the cleaning brush assembly through the cannon tube for as many cycles as required to adequately clean the cannon tube for inspections.

It is obvious that many modifications and variations of the present invention are possible in light of the above teachings. It is therefore to be understood that within the scope of the appended claims, the invention may be practiced otherwise than as described.

What is claimed is as new and desired to be secured by Letters Patent of the United States is:

1. A portable cannon tube cleaning system comprising:

a trailer designed to be pulled to the site of a cannon tube to be cleaned;

actuatable means securely mounted to the floor of the trailer for providing vertical height adjustment;

a main cleaner chassis assembly securely mounted to the actuatable means so that when the actuatable means is actuated the height of the main cleaner chassis assembly may be adjusted to be in line with the cannon tube to be cleaned; and means contained in the main cleaner chassis assembly for hauling a cleaning brush assembly through the cannon tube for as many cycles as required to adequately clean the tube for inspections, wherein the hauling means includes a winch cable.

2. The system recited in claim 1 wherein the actuatable means includes a lifting platform.

3. The system recited in claim 1 wherein the hauling means includes a hydraulic winch.

4. The system recited in claim 1 wherein the hauling means includes an air winch.

5. The system recited in claim 1 including a cleaning brush assembly operated on by the hauling means.

6. The system recited in claim 5 wherein the cleaning brush assembly includes a main cleaning head.

7. The system recited in claim 6 wherein the cleaning brush assembly includes a plurality of brushes.

8. The system recited in claim 7 wherein the brush material is nylon.

9. The system recited in claim 7 wherein the brush material is horse hair.

10. The system recited in claim 7 wherein the brush material is boar bristle.

11. The system recited in claim 7 wherein the brush material is stainless steel.

12. The system recited in claim 7 wherein the cleaning brush assembly includes a plurality of locking rings for holding the brushes on the main cleaning head.

13. The system recited in claim 12 wherein the cleaning brush assembly includes a front face mount and a rear face mount for mounting the main cleaning head.

14. A portable cannon tube cleaning system comprising:

a trailer designed to be pulled to the site of a cannon tube to be cleaned;

actuatable means securely mounted to the floor of the trailer for providing vertical height adjustment;

a main cleaner chassis assembly securely mounted to the actuatable means so that when the actuatable means is actuated the height of the main cleaner chassis assembly may be adjusted to be in line with the cannon tube to be cleaned; and means contained in the main cleaner chassis assembly for hauling a cleaning brush assembly through the cannon tube for as many cycles as required to adequately clean the tube for inspections, wherein the hauling means includes an electric winch.

* * * * *